US008175518B2

(12) United States Patent
Underwood et al.

(10) Patent No.: US 8,175,518 B2
(45) Date of Patent: May 8, 2012

(54) SYSTEM FOR AND METHOD OF RECEIVING INTERNET RADIO BROADCAST VIA SATELLITE RADIO

(75) Inventors: Rosa M. Underwood, Washington, DC (US); Henry Mckelvey, Capitol Heights, MD (US); Jimmie D. Peterman, Glenndale, MD (US); Emory L. Young, Reisterstown, MD (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 371 days.

(21) Appl. No.: 12/496,222

(22) Filed: Jul. 1, 2009

(65) Prior Publication Data

US 2011/0003544 A1 Jan. 6, 2011

(51) Int. Cl.
*H04H 40/00* (2008.01)

(52) U.S. Cl. ..... 455/3.06; 455/3.02; 455/410; 455/411; 715/16

(58) Field of Classification Search ..... 455/3.02, 455/3.06, 414.1, 414.4, 425, 427, 428, 432.2, 455/12.1, 41.2, 552.1, 553.1, 127.4, 466, 455/410, 411, 415, 420; 726/34; 725/143, 725/144, 148, 151, 47, 87; 715/716
See application file for complete search history.

(56) References Cited

U.S. PATENT DOCUMENTS

| | | | | |
|---|---|---|---|---|
| 2005/0060759 | A1* | 3/2005 | Rowe et al. | 725/143 |
| 2006/0111899 | A1* | 5/2006 | Padhi et al. | 704/221 |
| 2010/0023860 | A1* | 1/2010 | Toro-Lisoni | 715/716 |
| 2010/0083386 | A1* | 4/2010 | Kline et al. | 726/34 |
| 2010/0222088 | A1* | 9/2010 | Dragt | 455/466 |

* cited by examiner

*Primary Examiner* — Tan Trinh

(57) ABSTRACT

A system for and method of receiving internet radio broadcast via satellite radio is presented. The system and method allow internet radio to be delivered to consumers on a mobile electronic device. Internet radio can be individually customized to deliver certain types of content and can also deliver on-demand content. The system and method therefore provides for the delivery of customizable on-demand content to a consumer's mobile device with the stable and wide-ranging connectivity of satellite radio.

19 Claims, 5 Drawing Sheets

SYSTEM FOR AND METHOD OF RECEIVING INTERNET RADIO BROADCAST VIA SATELLITE RADIO

BACKGROUND INFORMATION

Conventional satellite radio services provide access to many different stations or channels, but are not able to deliver on-demand content to the customer. Internet radio, on the other hand, is able to deliver on-demand content to customers, but is unable to provide stable connectivity to mobile customers.

BRIEF DESCRIPTION OF THE DRAWINGS

The present invention, together with further objects and advantages, may best be understood by reference to the following description taken in conjunction with the accompanying drawings, in the several figures of which like reference numerals identify like elements, and in which:

FIG. 3(*b*) illustrates the appearance of a user interface in accordance with exemplary embodiments.

DETAILED DESCRIPTION OF PREFERRED EMBODIMENTS

Satellite radio has gained in popularity because it is able to provide subscribers with more stations than conventional radio, and those stations are not limited geographically like conventional radio stations. In other words, with satellite radio, there is little to no risk of losing a good station as you drive along a highway.

Internet radio has also gained in popularity. This is at least in part due to the capability of many internet radio service providers to provide such features as on-demand content, playlist creation, and customizable channels.

Satellite radio currently does not provide on-demand and/or customizable content. Internet radio currently does not provide connectivity to the mobile customer in a stable fashion. Exemplary systems and methods of the present invention provide a user with the ability to customize audio content as with internet radio, and have the customized content broadcast by satellite transmission. As such, users can have access to on-demand content, for example, on a mobile device (e.g., a cellular phone, or PDA) so long as the mobile device is equipped with a satellite receiver.

Figure 1:
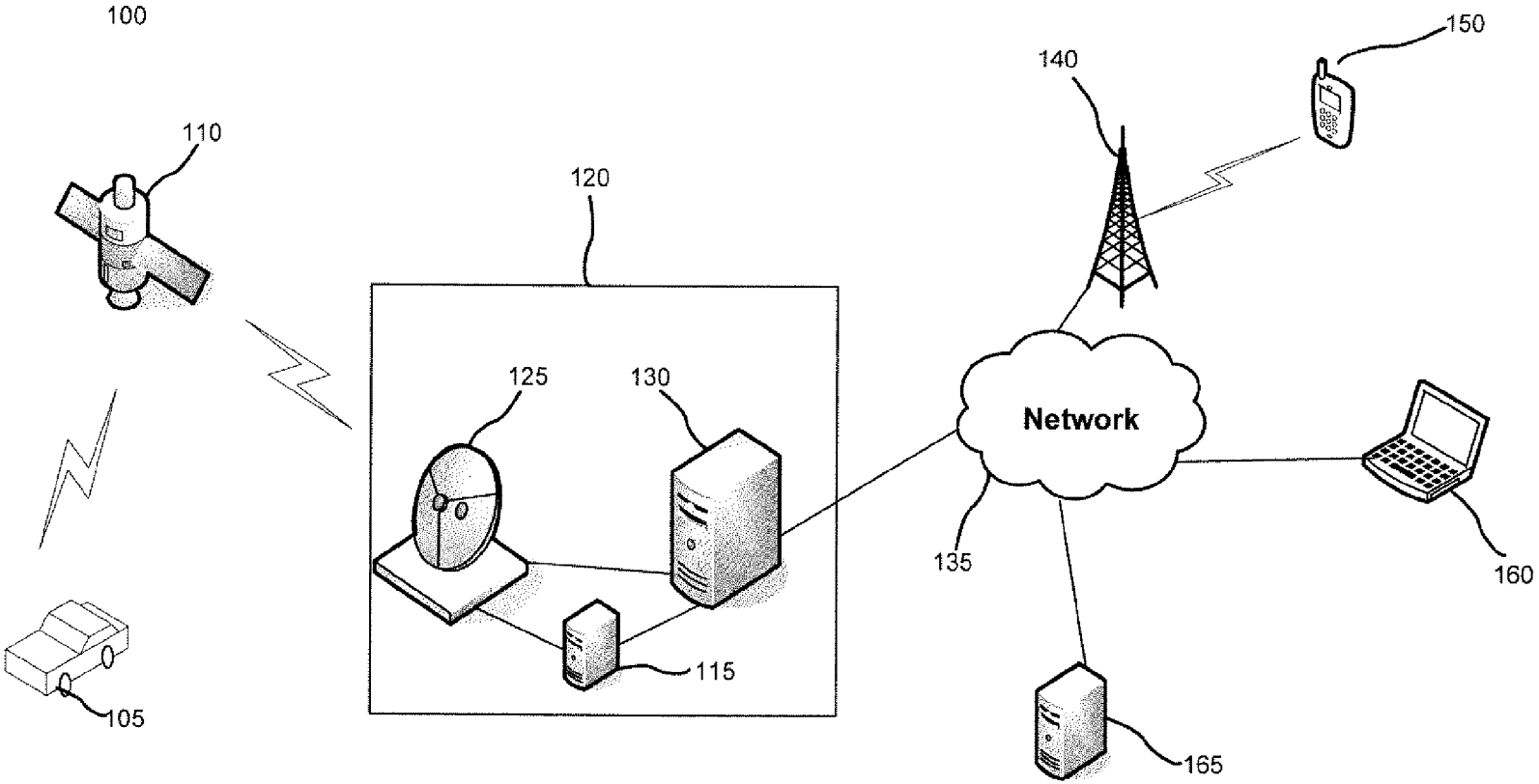
FIG. 1 is a schematic diagram illustrating an exemplary network environment where the systems for and methods of receiving internet radio broadcast via satellite radio may be performed in accordance with exemplary embodiments.

FIG. 1 is a schematic diagram illustrating an exemplary network environment where systems and methods for receiving internet radio broadcast via satellite radio may be performed in accordance with exemplary embodiments. Satellite radio service provider 120 may include ground station transmitter 125, satellite radio service provider server 130, and key server 115. It should be appreciated that ground station transmitter 125, satellite radio service provider 130, and key server 115 are depicted as single entity devices for the sake of illustrative simplicity, and that such depiction is non-limiting.

Satellite radio service provider server 130 may receive, store, and/or process audio content that may delivered over the various channels or stations that may be offered to subscribers by satellite radio service provider 120. Satellite radio service provider server 130 may be communicatively coupled with ground station transmitter 125 and may provide ground station transmitter 125 with content to be uplinked to satellite 110. Key server 115 may be communicatively coupled with ground station transmitter 125 and satellite radio service provider server 130. Key server 115 may be used to authenticate a transmission with a satellite receiver embodied in consumer's equipment 105.

Satellite 110 may broadcast satellite signals, which may include audio content, storing content over a broad geographic region (e.g. an entire continent). The signal broadcast by satellite 110 may be proprietary in nature and may require specialized hardware to be decoded, demodulated, and/or decrypted. The signal broadcast by satellite 110 may be at a frequency of 2.3 GHz (S Band) in, by way of non-limiting example, North America. In regions other than North America, by way of non-limiting example, the signal may share the 1.4 GHz (L band) frequency with local Digital Audio Broadcasting (DAB) stations. Satellite 110 may broadcast a signal strong enough to be received without a satellite dish.

The signal broadcast from satellite 110 may be received directly by a consumer's equipment 105. In some locations, however, the satellite signal may be blocked because of, for example skyscrapers or tunnels. In these locations, local repeaters may be used to broadcast the signal to a consumer's equipment 105.

Consumer's equipment 105 is depicted in FIG. 1 as being in an automobile (i.e., a consumer operating the automobile). This depiction is purely exemplary and it should be appreciated that a consumer's equipment 105 may receive a satellite signal on different devices and in different locations. Consumer's equipment 105 may receive the satellite signal in an automobile on a portable receiver. Consumer's equipment 105 may receive the satellite signal on a satellite receiver installed directly into the vehicle. Consumer's equipment 105 could be on a train or a bus receiving the satellite signal on a mobile device equipped with a satellite receiver. Consumer's equipment 105 may also receive the signal directly into their home, either on a built-in or stationary satellite receiver or on a receiver in a mobile device such as a cellular phone or PDA.

Satellite radio service provider 130 may be communicatively coupled with a network 135. Network 135 may be a wireless network, a wired network or any combination of wireless network and wired network. For example, network 135 may include one or more of a fiber optics network, a passive optical network, a cable network, an Internet network, a satellite network (e.g., operating in Band C, Band Ku or Band Ka), a wireless LAN, a Global System for Mobile Communication ("GSM"), a Personal Communication Service ("PCS"), a Personal Area Network ("PAN"), D-AMPS, Wi-Fi, Fixed Wireless Data, IEEE 802.11a, 802.11b, 802.15.1, 802.11n and 802.11g or any other wired or wireless network for transmitting and/or receiving a data signal. In addition, network 135 may include, without limitation, telephone line, fiber optics, EE Ethernet 802.3, a wide area network ("WAN"), a local area network ("LAN"), or a global network such as the Internet. Also, network 135 may support, an Internet network, a wireless communication network, a cellular network, or the like, or any combination thereof. Network 135 may further include one, or any number of the exemplary types of networks mentioned above operating as a stand-alone network or in cooperation with each other. Network 135 may utilize one or more protocols of one or more network elements to which it is communicatively coupled. Network 135 may translate to or from other protocols to one or more protocols of network devices. Although network 135 is depicted as one network, it should be appreciated that according to one or more embodiments, network 135 may comprise a plurality of interconnected networks, such as, for example, a service provider network, the Internet, a broadcaster's network, a cable television network, corporate networks, and home networks.

Internet radio server 165 may be communicatively coupled to network 135. Internet radio server 165 may host an internet radio service and may store audio content. Internet radio server 165 may present an interface to users so that users can select audio content. Internet radio server 165 may transmit selected content to a user. Internet radio audio content may be delivered to a user via streaming technology using a lossy audio codec such as MPEG. Streaming audio formats may include, by way of non-limiting example, MP3, Ogg Vorbis, Windows Media Player, RealAudio and HE-ACC. The bits may be streamed (or transported) over the network in TCP or UDP packets, then reassembled and played at the user's location.

Internet radio providers may provide pre-set channels that, upon user selection, may be transmitted to the user in a streaming format. Pre-set channels or stations of an internet radio provider may correspond to a musical genre. Thus, a user may select, for example, an Electronic/Dance channel, and the internet radio provider may stream songs to the user that fall into the category of Electronic/Dance music.

Internet radio providers may also provide on-demand capabilities that allow a user to select and play audio content such as a song or a concert. On-demand capabilities are not limited to music and may allow the user to select any type of audio content, such as, by way of non-limiting example, weather forecasts, talk radio segments, political debates, audiobooks, speeches, verbal editorials, etc. Further, internet radio providers may allow users to create playlists of personally selected audio content.

Internet radio providers may examine the music selections of a user and create customized playlists with songs meant to appeal to the user's preferences. Internet radio providers may use methods and algorithms for customization that may involve some combination of analyzing genre, artist, tempo, tone, or other factors that may be relevant in determining the musical preferences of a given customer. For example, a user could create a customized list that included several genres of music. A user may select several genres, and the internet radio provider may be able to provide a channel to the user that is customized based on these selected genres. For example, a user may select Country, Hip-Hop, and Jazz as their favorite genres and the Internet radio provider may provide a customized channel in which the songs streamed to the user are narrowed down according to these selected genres. Further, a customizable channel may be narrowed down by artist, previously selected tracks, or some combination of those or other factors.

Various other devices may be communicatively coupled to network 135. A computing device 160 may be communicatively coupled to network 135 through an ISP or some other suitable network connection mechanism. The computing device 160 is depicted as a laptop computer for the sake of illustrative simplicity. It should be appreciated that computing device 160 encompasses a Personal Computer ("PC") or other computing devices. A wireless tower 140 may be communicatively coupled to network 135. A wireless device 150, such as, by way of non-limiting example, a cellular phone or PDA, may communicate with wireless tower 140. Signals sent from wireless device 150 to wireless tower 140 may then be transmitted from the wireless tower 140 to network 135 via a wired connection.

Figure 2:
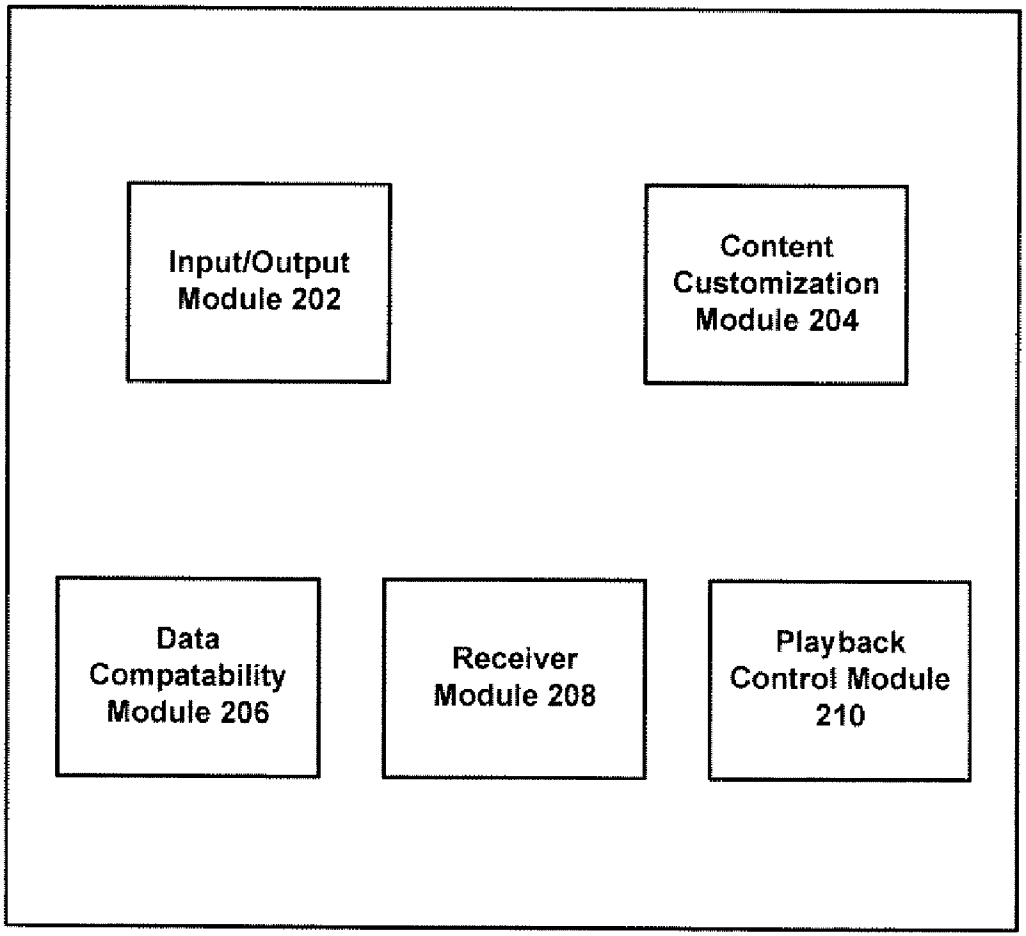
FIG. 2 is a block diagram of an internet radio via satellite transmission module in accordance with exemplary embodiments.

FIG. 2 is a block diagram of an internet-radio-via-satellite transmission module in accordance with exemplary embodiments. Input/output module 202 may allow the user to input information including information identifying a satellite receiver, personal key information, subscription and/or billing preferences, and information relating to content customization. Also, input/output module may include audio output devices for outputting audio content to a user.

Input/output module 202 may exist as a software application executing on a PC or laptop device configured to access a user interface. A user interface may be hosted at a internet radio server or at another web site that may be configured to receive such as information as, for example, URL's or hyperlinks to customized channels from an internet radio provider, a satellite receiver identification code, and a user's personal key. Input/output module 202 may exist on a mobile device that provides applications by which a user may access a user interface of a internet radio server. Input/output module 202 may include a touch screen, a key pad, a mouse, or other devices for facilitating user input to a website or other user interface.

Content customization module 204 may exist as a software application at an internet radio provider hosted at an internet radio server. Content customization module 204 may exist as a software application at a website that does not necessarily provide internet radio service, but which may be configured to receive information corresponding to customized channels or stations from an internet radio service provider, and also satellite receiver identification codes and personal key information. Content customization module 204 may also be located at a mobile device used by a user to make content-customizing selections.

Content customization module 204 may provide a user with a user interface that allows the users to search or browse content to make on-demand selections. Content customization module 204 may provide the capability for users to create playlists from available selections of an official content source.

Content customization module 204 may provide different mechanisms to allow users to customize channels or have channels customized for them. To that end, content customization module 204 may provide for the creation of user accounts, so that that a user's content selections may be stored and analyzed to determine a user's preferences. Content customization module 204 may examine the music selections of a user, determine user preferences based on those selections, and create playlists or channels in accordance with determined user preferences. Content customization module 204 may provide dedicated hardware or programmed software stored in computer readable memory for storing methods and algorithms for analyzing user preferences using such factors as, by way of non-limiting example, genre, artist, tempo, tone, previously selected audio content and/or other factors that may be relevant to determining the musical preferences of a given customer.

Content customization module 204 may work in conjunction with at least input/output module 202 which may provide user selections that content customization module 204 may use to customize channels. Content customization module 204 may also work in conjunction with data compatibility module 206 in that the customized content may be packaged into a format suitable for network transmission, and then transmitted to a user.

Data compatibility module 206 may format user-selected audio content in accordance with transmission protocols suitable for transmission over different types of transmission mediums.

Data compatibility module 206 may be configured to transmit or deliver user-selected audio content, and manages to format or package the audio content so that it can be transmitted elsewhere for a different kind of distribution. The data compatibility module 206 is not necessarily located at a single device and may include dedicated hardware or programmed software stored in computer readable memory at an internet radio provider, a satellite service provider, and/or a satellite receiver.

Data compatibility module 206 may format selected audio content into a stream of data packets to be transmitted over a packet switched network. The portion of data compatibility module 206 that may exist on an internet radio server may format the audio data in this matter. Data compatibility module 206 may transmit the stream of data packets to satellite service provider 120. Data compatibility module 206 may convert the format (e.g. TCP-IP data packets) of data received at a satellite service provider from an internet radio provider to a format suitable for satellite transmission.

Data compatibility module 206 may also include programmed software stored on a computer readable medium and/or dedicated hardware configured to perform a key exchange operation between a satellite receiver and a satellite service provider. Such a key exchange may be performed in order to maintain the security of a satellite transmission between a satellite service provider and a satellite receiver. This key exchange operation may occur after a satellite receiver answers back from a service broadcast from an internet radio provider with a call to the satellite service provider server.

In some embodiments, data compatibility module 206 may generate a key using any encryption or hashing algorithm, such as, by way of non-limiting example, MD5. This key may be generated when a user creates an account via a web interface. The generated key may be matched with satellite receiver identification information. On an initial startup of a satellite receiver, and after a user may make changes to their profile, the satellite receiver may authenticate with a key server (e.g. a key server 115 as depicted in FIG. 1) using digital certificates, which may be placed within a satellite provider's network.

In some embodiments, the data compatibility module 206 may format audio content by including identifying metadata about the audio content (e.g., song title, artist, album, etc.). Such metadata may be displayed to the user on an input/output module 202. The metadata may be displayed while the content is playing. The manner in which the metadata may be displayed may be controlled on an input/output module 202.

Receiver Module 208 may receive a wireless satellite signal from satellite 110 and decode and decrypt the signal. Receiver module 208 may send the decoded, decrypted audio signal to output speakers. Receiver module 208 may have an identification code associated with it. The identification code of the receiver module 208 may allow a subscriber to get access to the stations or channels they signed up for. Satellite signals may be encoded and encrypted to block access to underlying audio content. The satellite receiver identification code may unblock certain of the stations or channels and may allow for these channels to be heard.

Playback control module 210 may be located at a mobile device, which may be a separate device from the satellite receiver, or the mobile device could have a satellite receiver in the device itself. Playback control module 210 may allow satellite radio subscribers to switch back and forth between the channels they have already paid for each month with their monthly payments and the on-demand selections they have purchased, which may be an additional charge on top of the monthly fee. The playback control module 210 may work in conjunction with an input/output module to determine whether the user wants to hear customized audio content originating from an internet radio provider or listen to the channels that are available under a their satellite radio subscription.

Figure 3A:
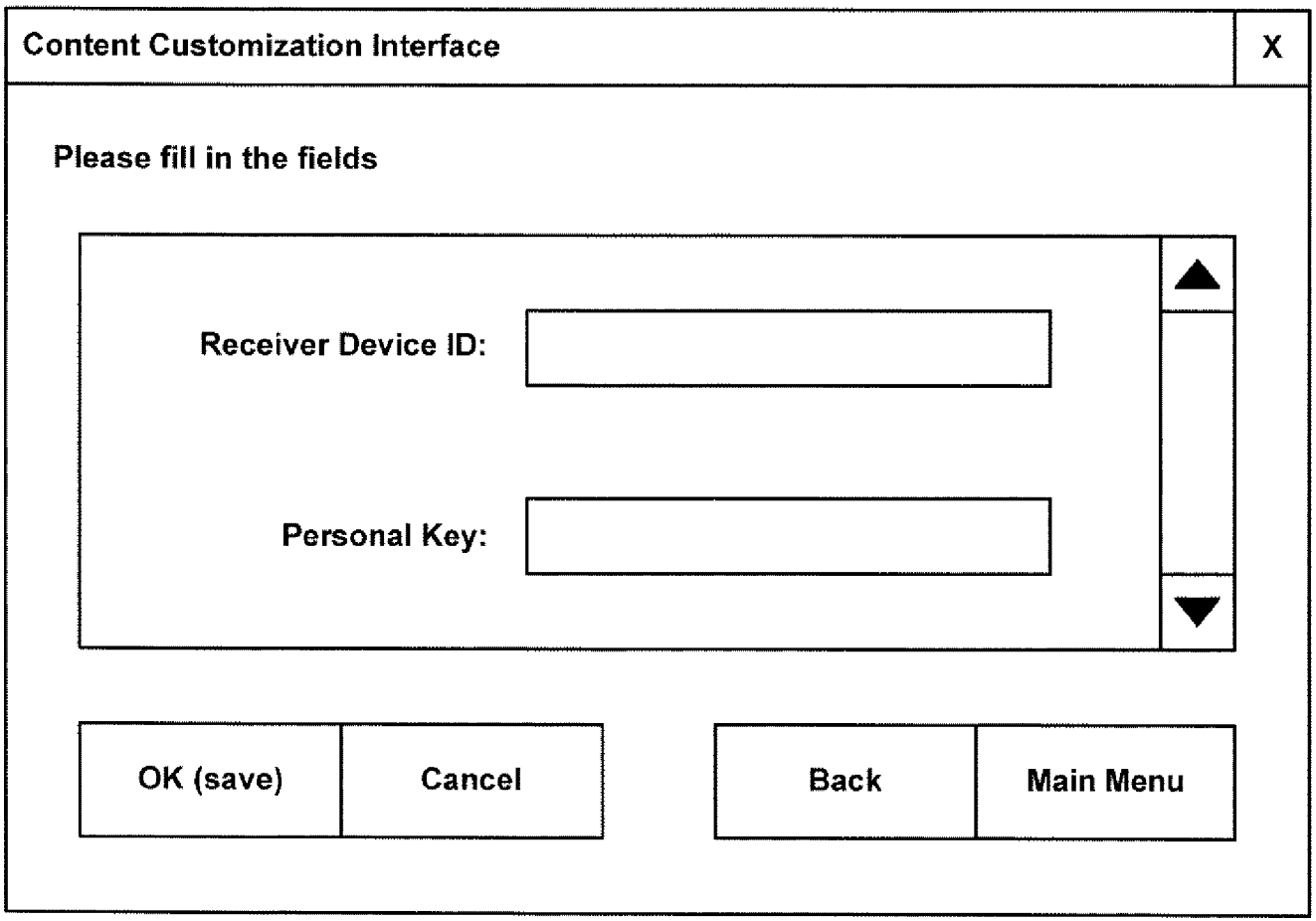
FIG. 3(*a*) illustrates the appearance of a user interface in accordance with exemplary embodiments.
Figure 3B:
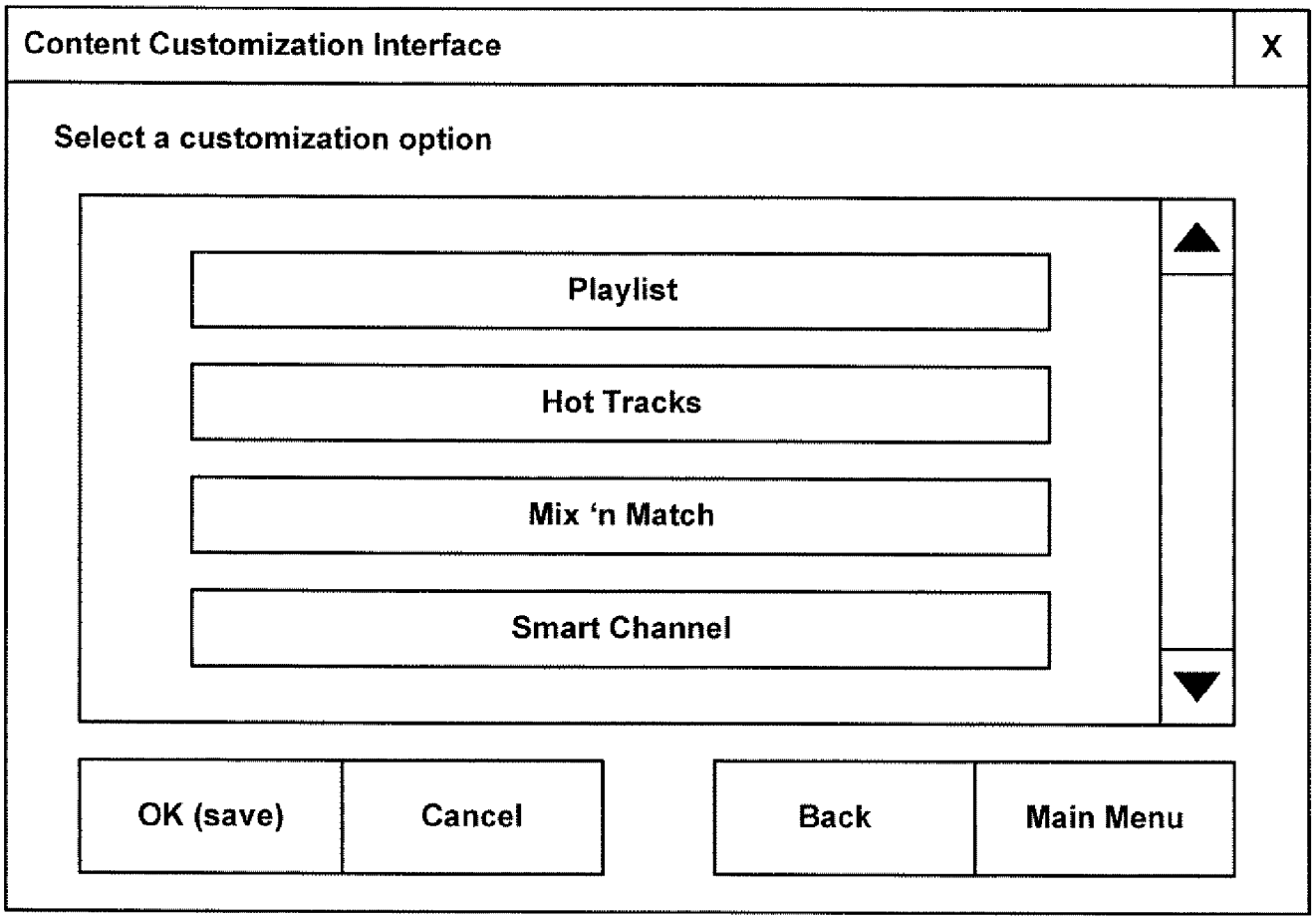

FIG. 3(*a*) illustrates the appearance of a user interface in accordance with exemplary embodiments. FIG. 3A may be a user interfaces that a user may see at a mobile device that has an application, and allows a user to communicate, and input information through an application on a mobile device or through a website on a PC or a laptop. As illustrated in FIG. 3A, there may be a field for the satellite receiver identification code. A user may input this information by looking at the satellite receiver and finding the code printed on the device itself. In some embodiments, a user's wireless mobile device detects this identification code directly through a wireless interface (e.g., Bluetooth or wi-fi). In some embodiments, after the device code is detected, an input/output module (e.g. input/output module 202 in FIG. 2) may populate this field with the device code such that user entry of the code is not required.

Satellite radio providers have limited bandwidth by which to transmit audio content. As such, there may be a limited number of frequencies (channels) by which audio content may be transmitted. A subscriber to a satellite radio service may have access to, by way of non-limiting example, 221 different audio channels. In exemplary embodiments, the customized content selected by a user—e.g., an internet radio station or a playlist of user-selected audio content—may be transmitted to a user's satellite receiver on a channel other than the 221 audio channels that may come with the satellite radio service. Because bandwidth is limited, it is possible that the customized content of different users could be transmitted over the same frequency channel. If two users are listening to different audio content over the same frequency within a reasonable proximity to each other, this could create the potential for interference between the signals.

In an exemplary embodiment, this potential for interference may be prevented by a direct-sequence spread-spectrum transmission technique. With this technique, the data to be transmitted may be multiplied by a sequence of values with a higher frequency than that of the original signal. This multiplication may spread the energy of the original signal into a wider band. The resulting signal may resemble white noise, which may prevent the signal from causing interference. The resulting signal may be used to reconstruct the original data at the receiving end by multiplying it by the same sequence of values. As illustrated, there may also be an input for the user's personal key. The sequence of values that make up the personal key may be multiplied by the original signal, in the manner described above, to encode a user's channel such that proximity to the same channel does not cause interference between the signals. This may allow on-demand content to be delivered to multiple users without interference.

FIG. 3(*b*) illustrates the appearance of a user interface in accordance with exemplary embodiments. This interface may allow the user to select between methods of customizing the content that they will receive. The first link may allow a user to create a playlist. The second link may allow a user to listen to a channel of the most popular music, or to peruse the most popular new music and make on-demand selections from there. The third link may allow a user to select different genres as a way of customizing a channel. The fourth link may allow a user to do all of the actions that may already be performed in the system, but may add the additional feature of allowing a content customization module to analyze the selections of a particular user and create customized channels based on an analysis of a user's past selections. Further, a content customization module may provide a mechanism for a user to mark or tag their favorite songs so that this information may be taken into account when analyzing a user's preferences. The various methods of customizing content have been discussed in greater detail with respect to FIGS. 1 and 2.

Figure 4:
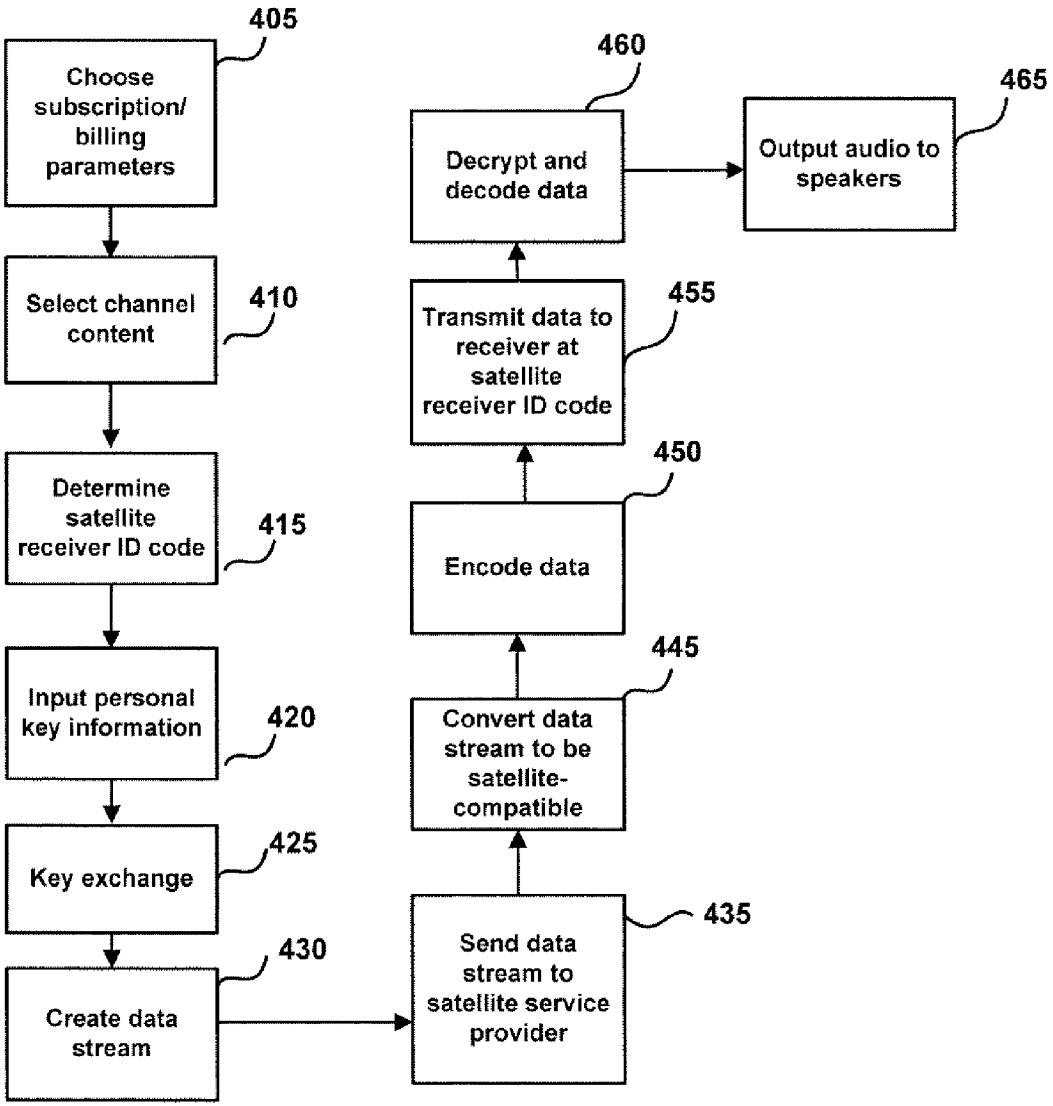
FIG. 4 is a flowchart illustrating a method of receiving internet radio broadcast via satellite radio in accordance with exemplary embodiments.

FIG. 4 is a flowchart illustrating a method of receiving internet radio broadcast via satellite radio in accordance with exemplary embodiments. In block 405, subscription or billing parameters may be chosen. This may be an operation an input/output module (e.g., input/output module 202 in FIG. 2). Both subscribers to satellite radio and non-subscribers to satellite radio can both use this service and receive on-demand and customizable content.

A non-subscriber would still need to have a satellite receiver to receive the on-demand content. The non-subscriber could locate the satellite receiver identity code and still have the option of paying for on-demand content. The on-demand content may offered in different viewing packages. For example, the user may subscribe by the hour, day, week, etc.

A subscriber may also be able to purchase on-demand content in different viewing packages. The situation may be slightly different for the subscriber. For example, a subscriber may be paying $12.99 a month for 200 channels. By accessing on-demand channels, the subscriber is essentially adding a $201^{st}$ channel. This extra channel may include on-demand content and/or customizable channels. The subscriber may have to pay an extra fee for this extra on-demand channel. The subscription to this extra channel may be on a per hour, day, week, etc. basis, just as described with respect to the non-subscriber above. In some embodiments, the price structure may be different. In some embodiments, the charge for on-demand content may be greater for non-subscribers. Both non-subscribers and subscribers alike may have to select a billing option.

In block 410, content may be selected. To select content, a user may access the user interface and select on-demand programming, create a playlist of user selections, provide user preferences and/or user selections to facilitate a customizable channel selecting, or select an existing channel.

In block 415, the satellite receiver identification code may be determined. The satellite receiver identification code may unblock certain channels, allowing a user who is a subscriber to receive the subscribed-for channels. The identification may be determined by a user who simply reads the code off the device and inputs the code via an input/output module. The identification code may be determined by a mobile device that may be able to wirelessly identify the code.

In block 420, a user may input personal key information. An interface is shown in FIG. 3(*a*) where a user may input this information. The input personal key information may be used to encode data transmitted via satellite transmission to reduce potential interference if multiple users are on the same channel. This technique is described in greater detail in the discussion of block 450.

In block 425, a key exchange between data stream may be created for transmission across a network, such as a packet switched network. An internet radio provider may attempt to contact the satellite receiver to initiate a key exchange. A satellite receiver may respond to the internet radio provider by sending a message through the satellite service provider and to the internet radio provider. After a response message is sent back to the internet radio provider, the satellite service provider server and the satellite receiver may perform a key exchange. The key exchange may be a Diffie-Hellman key exchange. Alternatively, the key exchange may be performed in accordance with any other encryption or hashing algorithm (e.g., RSA, MD5).

In block 430 a data stream may be created that includes the user-selected or customized content. The data stream may include metadata that may identify characteristics of the audio content included in the data stream. The data stream may also include satellite receiver identification code and personal key information.

In block 435, the data stream may be sent to a satellite radio service provider. In block 445, the data may be converted from a data stream of multiple packets into a format conducive to satellite transmission.

In block 450, the data may be encoded by using the user's personal key information. In an exemplary embodiment, a potential for interference between multiple users listening to different content on the same frequency channel may be prevented by using personal key information to encode the signal. Specifically, the data to be transmitted may be multiplied by a user's personal key, which may be a sequence of values with a higher frequency than that of the original signal. This multiplication may spread the energy of the original signal into a wider band. The resulting signal may resemble white noise, which may prevent the signal from causing interference. The resulting signal may be used to reconstruct the original data at the receiving end by multiplying it again by a user's personal key. This encoding may allow on-demand content to be delivered to multiple users without interference.

In block 455, the data may be uplinked from the ground earth station of the satellite radio provider to a satellite. The satellite may then broadcast this data over a broad geographic swath. The broadcast satellite signal may be received by a satellite receiver. In block 460, a satellite receiver may decode and decrypt the data so that it may be played as audio. In block 465, an audio signal may be output to speakers.

The description above describes user devices, an analysis system, a communication network having network elements that are coupled to each other via one or more links (e.g., physical or logical), various networks of within a domain of the communication network, and other elements for coupling customers to the communication network, some of which are explicitly depicted, others of which are not. As used herein, the term "module" may be understood to refer to executable software, firmware, hardware, or various combinations thereof. It is noted that the modules are exemplary. The modules may be combined, integrated, separated, or duplicated to support various applications. Also, a function described herein as being performed at a particular module may be performed at one or more other modules and by one or more other devices instead of or in addition to the function performed at the particular module. Further, the modules may be implemented across multiple devices or other components local or remote to one another. Additionally, the modules may be moved from one device and added to another device, or may be included in both devices.

It is further noted that the software described herein may be tangibly embodied in one or more physical media, such as, but not limited to, a compact disc (CD), a digital versatile disc (DVD), a floppy disk, a hard drive, read only memory (ROM), random access memory (RAM), as well as other physical media capable of storing software, or combinations thereof. Moreover, the figures illustrate various components (e.g., servers, computers, etc.) separately. The functions described as being performed at various components may be performed at other components, and the various components may be combined or separated. Other modifications also may be made.

In the preceding specification, various preferred embodiments have been described with references to the accompanying drawings. It will, however, be evident that various modifications and changes may be made thereto, and additional embodiments may be implemented, without departing from the broader scope of invention as set forth in the claims that follow. The specification and drawings are accordingly to be regarded in an illustrative rather than restrictive sense.

We claim:

1. A method comprising:

accessing audio content configured for use in an internet radio service;

providing a user interface, wherein the user interface is configured to provides a user access to internet radio;

receiving an audio content selection;

receiving satellite receiver identification information;

receiving an identification key that corresponds to a user;

converting the selected audio into a data stream, wherein the data stream includes the satellite receiver identification information and the identification key; and transmitting the data stream to a satellite radio provider.

2. The method according to claim 1, wherein the data stream is configured to be broadcast via satellite radio.

3. The method according to claim 1, wherein the data stream comprises packets of data configured for transmission on a packet-switched network.

4. The method according to claim 1, wherein the satellite receiver identification information identifies the satellite receiver configured to receive the selected audio content.

5. The method according to claim 4, wherein the satellite receiver configured to receive the selected audio content is identified by the user.

6. The method according to claim 4, wherein the satellite receiver configured to receive the selected audio content is identified by a user's mobile device.

7. A computer readable media containing computer executable code comprising code to perform the acts of the method of claim 1.

8. A method comprising:

accessing audio content configured for use in an internet radio service;

providing a user interface, wherein the user interface is configured to provide a user access to internet radio;

receiving information regarding a user's audio content preferences;

receiving satellite receiver identification information and an identification key that corresponds to a user;

create a customized content channel based on user's audio content preferences;

converting the customized content channel into a data stream; and transmitting the data stream to a satellite radio provider.

9. The method according to claim 8, wherein the data stream includes the satellite receiver identification information and the identification key.

10. The method according to claim 8, wherein the information regarding a user's audio content preferences comprises one or more musical genres.

11. The method according to claim 8, wherein the information regarding a user's audio content preferences comprises one or more artists.

12. The method according to claim 8, wherein the information regarding a user's audio content preferences comprises one or more audio content selections.

13. A method comprising:

receiving data comprising at least audio content, satellite receiver identification information, and a user key;

converting the audio format into a different format conducive to satellite transmission, wherein the converted format is transmitted at a frequency channel;

encoding the frequency channel using the user key; and uplinking the frequency channel to a satellite, wherein the frequency channel is configured to be broadcast to the satellite receiver identified by the satellite receiver identification information and decoded by the satellite receiver.

14. The method of claim 13, wherein the received data originated from an Internet radio server.

15. The method of claim 14, wherein the audio content of the received data stream comprises on-demand audio selections.

16. The method of claim 14, wherein the audio content of the received data stream comprises music channels individually customized to a user's musical preferences.

17. The method of claim 13, further comprising performing a key exchange operation with the satellite receiver.

18. The method of claim 17, wherein the key exchange operation is a cryptographic protocol.

19. The method of claim 18 wherein the key exchange operation is selected from the group consisting of Diffie-Hellman key exchange, RSA key exchange, and MD5 key exchange.

* * * * *